US009359574B2

(12) United States Patent
Ayame et al.

(10) Patent No.: US 9,359,574 B2
(45) Date of Patent: Jun. 7, 2016

(54) LUBRICATING OIL COMPOSITION

(71) Applicant: JX NIPPON OIL & ENERGY CORPORATION, Tokyo (JP)

(72) Inventors: Noriko Ayame, Tokyo (JP); Yasushi Onumata, Tokyo (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 14/388,036

(22) PCT Filed: Mar. 29, 2013

(86) PCT No.: PCT/JP2013/059540
§ 371 (c)(1),
(2) Date: Sep. 25, 2014

(87) PCT Pub. No.: WO2013/147162
PCT Pub. Date: Oct. 3, 2013

(65) Prior Publication Data

US 2015/0051125 A1 Feb. 19, 2015

(30) Foreign Application Priority Data

Mar. 29, 2012 (JP) ..... 2012-077764

(51) Int. Cl.
*C10M 133/40* (2006.01)
*C10M 169/04* (2006.01)
*C10M 171/02* (2006.01)

(52) U.S. Cl.
CPC ..... *C10M 133/40* (2013.01); *C10M 169/041* (2013.01); *C10M 171/02* (2013.01);

(Continued)

(58) Field of Classification Search
CPC ..... C10M 169/041; C10M 133/40; C10M 171/02; C10M 2203/1025; C10M 2205/028; C10M 2215/08; C10M 2223/045; C10N 2210/02; C10N 2220/021; C10N 2220/022; C10N 2230/06; C10N 2230/54; C10N 2230/68; C10N 2240/04; C10N 2240/042; C10N 2240/044; C10N 2240/10
See application file for complete search history.

(56) References Cited

U.S. PATENT DOCUMENTS 2,543,964 A 3/1951 Giammaria
4,839,074 A * 6/1989 Rossi ..... C10M 145/02 44/395

(Continued)

FOREIGN PATENT DOCUMENTS

CA 1238448 A 6/1988
CN 101275100 A 10/2008

(Continued)

OTHER PUBLICATIONS

International Search Report dated May 8, 2013, PCT/JP2013/059540.

(Continued)

*Primary Examiner* — Cephia D Toomer
(74) *Attorney, Agent, or Firm* — Ladas & Parry LLP

(57) ABSTRACT

To provide is a lubricating oil composition capable of exerting an improved fuel-saving performance and having an improved shear stability.
The lubricating oil composition comprises (A) a mineral base oil having kinematic viscosity at 100° C. of no more than 5 $mm^2/s$ and % $C_P$ of no less than 90; and (B) a polymer having weight average molecular weight of no more than 15000.

4 Claims, 1 Drawing Sheet

(52) U.S. Cl.
CPC . *C10M2203/1025* (2013.01); *C10M 2205/028* (2013.01); *C10M 2207/289* (2013.01); *C10M 2209/084* (2013.01); *C10M 2215/08* (2013.01); *C10M 2223/04* (2013.01); *C10M 2223/045* (2013.01); *C10N 2210/02* (2013.01); *C10N 2220/021* (2013.01); *C10N 2220/022* (2013.01); *C10N 2230/06* (2013.01); *C10N 2230/54* (2013.01); *C10N 2230/68* (2013.01); *C10N 2240/04* (2013.01); *C10N 2240/042* (2013.01); *C10N 2240/044* (2013.01); *C10N 2240/10* (2013.01)

(56) References Cited

U.S. PATENT DOCUMENTS

| | | | |
|---|---|---|---|
| 2007/0287643 | A1 | 12/2007 | Matsui et al. |
| 2008/0312117 | A1 | 12/2008 | Wallfahrer et al. |
| 2011/0053815 | A1 | 3/2011 | Matsui et al. |

FOREIGN PATENT DOCUMENTS

| | | | |
|---|---|---|---|
| CN | 101883839 | A | 11/2010 |
| EP | 0075217 | A2 | 3/1983 |
| EP | 2009048 | A2 | 12/2008 |
| EP | 2014750 | A1 | 1/2009 |
| JP | 08-508056 | A | 8/1996 |
| JP | 11-286696 | A | 10/1999 |
| JP | 2003-514099 | A | 4/2003 |
| JP | 2004-262979 | A | 9/2004 |
| JP | 2006-198745 | A | 8/2006 |
| JP | 2008-208212 | A | 9/2008 |
| JP | 2008-308688 | A | 12/2008 |
| JP | 2011-021056 | A | 2/2011 |
| WO | 94/21757 | A1 | 9/1994 |
| WO | 01/34735 | A1 | 5/2001 |

OTHER PUBLICATIONS

Extended European Search Report dated Sep. 24, 2015; Appln. No. 13770125.6-1352/2832839 PCT/JP2013059540.

* cited by examiner

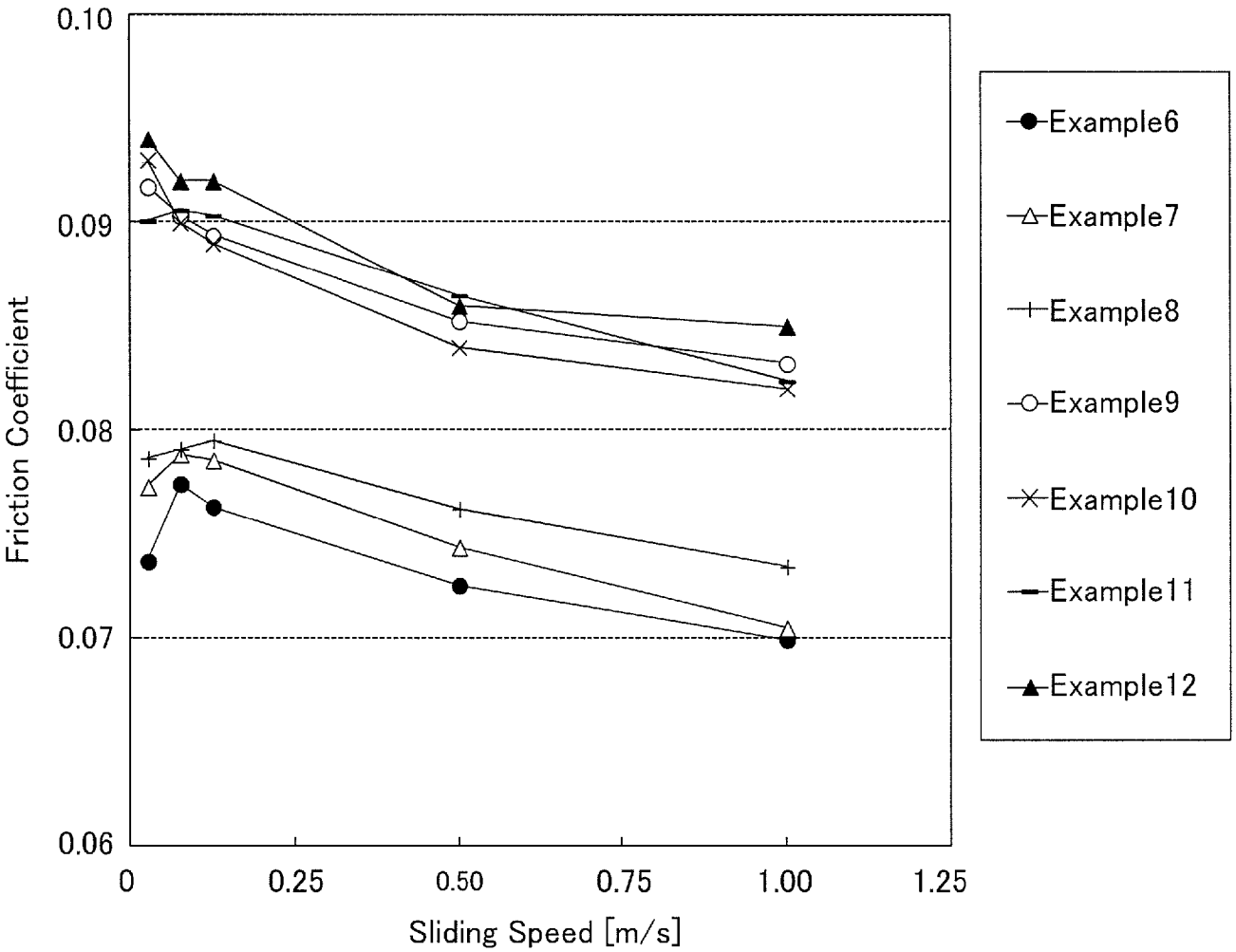
Example6
Example7
Example8
Example9
Example10
Example11
Example12
0.10
0.09
0.08
0.07
0.06
Friction Coefficient
0
0.25
0.50
0.75
1.00
1.25
Sliding Speed [m/s]

LUBRICATING OIL COMPOSITION

TECHNICAL FIELD

The present invention relates to a lubricating oil composition, more specifically, the present invention relates to a lubricating oil composition especially suitable for use in manual and automatic transmissions and/or continuously variable transmission.

BACKGROUND ART

For a lubricating oil composition used for automatic transmissions, manual transmissions, and internal-combustion engines, improvement in various durability such as thermal oxidative stability, wear resistance, fatigue prevention property, improvement in viscosity-temperature characteristics to improve fuel-saving performance, and improvement in low temperature viscosity characteristics such as reducing of viscosity in a low temperature and improvement of low temperature fluidity have been required. For the sake of such performance improvements, reformation of low temperature viscosity characteristics of base oil such as increasing viscosity index of the base oil has been attempted. With such a base oil, various additive agents such as antioxidants, cleaning dispersants, antiwear agents, friction modifiers, seal swelling agents, viscosity index improvers, antifoam agents, and coloring agents have been adequately combined to make a lubricating oil composition.

Currently, as a method to reform the viscosity-temperature characteristics for the purpose of improving fuel-saving performance, reducing viscosity of base oil at the same time increasing amount of the viscosity index improver has been generally carried out. However, in a case where the viscosity of base oil is reduced, the viscosity index improver is degraded by being subjected to shear, whereby thickening property of the viscosity index improver is impaired. As a result of this, whole viscosity of lubricating oil composition is reduced. Therefore, problems such as degradation of lubrication performance (lubricity) over time and shortage of oil pressure over time have been concerned.

Against these problems, in order to support the fuel-saving performance and the lubricity at the same time, improvement in viscosity characteristics of lubricating oil composition by combination use of a base oil having a high viscosity or by using a base oil having a good low temperature characteristics has been suggested. Also, improvement in lubricity and fatigue life of lubricating oil by adequately adding a phosphorus-based extreme pressure agent, sulfur-based extreme pressure agent and the like has been suggested (see Patent Documents 1 to 3).

However, as the performance of the lubricating oil has been further demanded, such improvements in fuel-saving performance and shear stability that can be realized by these conventionally-known method are becoming insufficient to the demand level to meet. Therefore, a development of a lubricating oil composition in which both of the fuel-saving performance and the shear stability are further improved has been required.

CITATION LIST

Patent Literatures

Patent Document 1: Japanese Patent Application Laid-Open Publication No. 2004-262979

Patent Document 2: Japanese Patent Application Laid-Open Publication No. H11-286696

Patent Document 3: Japanese Patent Application Laid-Open Publication No. 2003-514099

SUMMARY OF THE INVENTION

Problems to be Solved by the Invention

Accordingly, considering situations described above, an object of the present invention is to provide a lubricating oil composition that can exert a further improved fuel-saving performance and has a further improved shear stability. Also, the present invention provides a lubricating oil composition especially suitable for use in manual and automatic transmissions, and/or continuously variable transmissions.

Means for Solving the Problems

The present invention solves the problems described above by providing a lubricating oil composition comprising (A) a mineral base oil having kinematic viscosity at 100° C. of no more than 5 $mm^2/s$, and % $C_P$ of no less than 90, and (B) a polymer having weight average molecular weight of no more than 15000.

In the lubricating oil composition of the present invention, it is preferable that the (A) mineral base oil has % $C_N$ of no more than 15.

In the lubricating oil composition of the present invention, it is preferable that the component (B) is a copolymer of an α-olefin and an α,β-ethylenic unsaturated dicarboxylic acid diester.

The lubricating oil composition of the present invention preferably further comprises (D) an amide friction modifier. In the present invention, the "amide friction modifier" refers to a friction modifier being a compound having an amide (>N—C—O—) bond in its molecular structure, and includes a friction modifier being an urea compound, imide compound and the like.

The lubricating oil composition of the present invention can be suitably used as a lubricating oil for transmissions.

Effect of the Invention

According to the lubricating oil composition of the present invention, since the composition contains both of the (A) prescribed base oil and the (B) prescribed polymer, it is possible to provide a lubricating oil composition in which traction coefficient is reduced to improve the fuel-saving performance and at the same time the shear stability is improved. Also, since the lubricating oil composition of the present invention is improved in maintenance capability of the viscosity characteristics by improvement of the shear stability, maintenance capability of the lubricating performance is also improved.

BRIEF DESCRIPTION OF THE DRAWINGS

FIG. 1 is a graph in which results of a ring-on-disk test of lubricating oil compositions of Examples 6 to 12 are plotted.

MODES FOR CARRYING OUT THE INVENTION

Hereinafter, the present invention will be described in detail. It should be noted that, unless otherwise mentioned, "A to B" regarding numerical values A and B means "A or more and B or less". In cases where the unit of the numerical value A is omitted, the unit given to the numerical value B is applied as the unit of the numerical value A.

<Component (A)>

The component (A) in the lubricating oil composition of the present invention is a mineral base oil having kinematic viscosity at 100° C. of no more than 5 $mm^2/s$, and % $C_P$ of no less than 90.

The kinematic viscosity of the component (A) at 100° C. is no more than 5 $mm^2/s$, preferably no more than 4.5 $mm^2/s$, more preferably no more than 4.2=$^2/s$, still preferably no more than 4 $mm^2/s$, especially preferably no more than 3.5 $mm^2/s$, and most preferably no more than 3 $mm^2/s$. Also, preferably no less than 1.5 $mm^2/s$, more preferably no less than 2 $mm^2/s$, and still preferably no less than 2.5 $mm^2/s$.

By having the kinematic viscosity of the component (A) at 100° C. of no more than the upper limit value described above, it is possible to improve the viscosity-temperature characteristic and the low-temperature viscosity characteristic.

Also, by having the kinematic viscosity of the component (A) at 100° C. of no less than the lower limit value described above, it is possible to sufficiently form oil membrane at lubricating points, whereby it is possible to improve metal fatigue preventing property and load resistance capacity. It is also possible to reduce evaporative loss of base oil of the lubricating base oil.

Flow point of the component (A) is not particularly limited, however, preferably no more than −15° C., more preferably no more than −17.5° C., still preferably no more than −20° C., especially preferably no more than −25° C., and most preferably no more than −30° C. By having the flow point of the component (A) of no more than the upper limit value described above, it is possible to obtain a lubricating oil composition having an improved low-temperature viscosity characteristic. Also, in view having a low-temperature viscosity characteristic and economy efficiency in a case where a dewaxing step is carried out, the flow point is preferably no less than −45° C., more preferably no less than −40° C., and still preferably no less than −37.5° C.

Viscosity index of the component (A) is not particularly limited, however, preferably no less than 100, more preferably no less than 110, still preferably no less than 120, and especially preferably no less than 125. Also, as an embodiment of the present invention, the viscosity index of the component (A) can be no less than 160, however, in view of having a better solubility of additive agent and sludge, preferably no more than 150. By having the viscosity index of the component (A) of no less than the lower limit value described above, it is possible to obtain a lubricating oil composition having an improved viscosity-temperature characteristic and an improved low-temperature viscosity characteristic.

The component (A) has % $C_P$ of no less than 90. This makes it possible to significantly reduce the traction coefficient that contributes to improvement of the fuel-saving performance in the present invention. Upper limit of % $C_P$ is not particularly limited, and can be 100 as an embodiment of the present invention, however, in view of having a better solubility of additive agent and sludge, preferably no more than 98, and more preferably no more than 95.

There is no particular limitation in % $C_A$ of the component (A), however, preferably 0 or more and 5 or less, and in view of improving heat/oxidation stability and the viscosity-temperature characteristic, more preferably no more than 3, still preferably no more than 2, and especially preferably no more than 1.

Also, % $C_N$ of the component (A) is preferably no more than 15, more preferably no more than 10, and especially preferably no more than 8. By having % $C_N$ of no more than the upper limit value described above, it is possible to further reduce the traction coefficient that contributes to improvement of the fuel-saving performance in the present invention. Lower limit of % $C_N$ is not particularly limited, however, in view of having a better solubility of additive agent and sludge, preferably no less than 2, and more preferably no less than 5.

It should be noted that % $C_A$, % $C_P$ and % $C_N$ in the present invention each means a percentage of number of aromatic carbons to total number of carbons, a percentage of number of carbons of paraffin to the total number of carbons, and a percentage of number of carbons of naphthen to the total number of carbons each obtained by a method compliant with ASTM D 3238 (n-d-M ring analysis).

Sulfur content of the component (A) is not particularly limited, however, preferably no more than 0.1 mass %, more preferably no more than 0.05 mass %, and still preferably no more than 0.01 mass %.

Nitrogen content of the component (A) is not particularly limited, however, in view of obtaining a composition having a better heat/oxidation stability, preferably no more than 5 mass ppm, and more preferably no more than 3 mass ppm.

The component (A) can be one kind of mineral oil, or can be a mixture of two or more kinds of mineral oils.

Producing method of the component (A) is not particularly limited as long as the component (A) has properties described above, however, in specific, a base oil having base oils (1) to (8) shown below as raw materials and obtained by distilling these oils as raw materials and/or lubricating oil distillate recovered from the oils as raw materials by means of a predetermined refining method, thereby recovering the lubricating oil distillate can be exemplified.

(1) A distillate oil by atmospheric distillation of a paraffinic crude and/or a mixed crude;

(2) A distillate oil distillated under a reduced pressure of an atmosphere distillation residual oil of a paraffinic crude and/or a mixed crude (WVGO);

(3) A wax obtained by lubricating oil dewaxing step (slack wax and the like) and/or a synthetic wax obtained by a gas-to-liquid (GTL) process and the like (Fischer Tropsch wax, GTL wax and the like);

(4) A mixed oil of one or more selected from the group consisting of the base oils (1) to (3) and/or a mild hydrocracking treatment oil of the mixed oil;

(5) A mixed oil of two or more selected from the group consisting of the base oils (1) to (4);

(6) A deasphalted oil (DAO) of the base oil (1), (2), (3), (4), or (5);

(7) A mild hydrocracking treatment oil (MHC) of the base oil (6);

(8) A mixed oil of two or more selected from the group consisting of the base oils (1) to (7).

As the component (A) of the present invention, a mineral base oil obtained from the raw material (3) described above is especially preferable.

As the predetermined refining method described above, hydrogenation refining such as hydrogenolysis and hydrofinishing; solvent refining such as furfural solvent extraction; dewaxing such as solvent dewaxing and catalytic dewaxing; clay refining by acid clay, activated clay and the like; chemical (acid or alkali) cleaning such as sulfuric acid cleaning and caustic soda cleaning are preferable. In the present invention, one kind of these refining methods can be carried out alone, or two or more kinds of these refining methods can be carried out in combination. Also, in a case where two or more kinds of these refining methods are combined, the order is not particularly limited, and can be adequately decided. As the dewaxing step, both of the solvent dewaxing and catalytic dewaxing can be applied, however, in view of further improving low-temperature viscosity characteristic, the catalytic dewaxing is especially preferable.

Further, as the lubricating base oil according to the present invention, the following base oils (9) or (10) obtained by carrying out predetermined treatment to a base oil selected from the group consisting of the base oils (1) to (8) described above or to the lubricating oil distillate recovered from the base oils are especially preferable.

(9) Hydrocracked mineral oil obtained by: hydrocracking a base oil selected from the group consisting of the base oils (1) to (8) or lubricating oil distillate recovered from the selected base oil; then carrying out dewaxing such as solvent dewaxing and catalytic dewaxing to the resulting product or lubricating oil distillate recovered from the resulting product by distillation and the like, or carrying out such a dewaxing followed by distillation.

(10) Hydroisomerized mineral oil obtained by: hydroisomerizing a base oil selected from the group consisting of the base oils (1) to (8) or lubricating oil distillate recovered from the selected base oil; then carrying out dewaxing such as solvent dewaxing and catalytic dewaxing to the resulting product or lubricating oil distillate recovered from the resulting product by distillation and the like, or carrying out such a dewaxing followed by distillation.

In obtaining the lubricating base oil of (9) or (10) described above, as the dewaxing step, in view of further improving heat/oxidation stability and low-temperature viscosity characteristic, and further improving fatigue prevention performance of the lubricating oil composition, it is especially preferable to include a catalytic dewaxing step.

Also, in obtaining the lubricating base oil of (9) or (10), a solvent refining treatment step and/or a hydrofinishing treatment step may be further provided as needed.

<Component (B)>

The lubricating oil composition of the present invention includes, in addition to the component (A), a polymer having weight average molecular weight (hereinafter sometimes referred to as "Mw" in short) of no more than 15000.

Structure of the polymer (B) having weight average molecular weight of no more than 15000 is not particularly limited as long as the polymer (B) can be dissolved in the component (A). As a specific example of the component (B), a copolymer of ethylene and propylene; polybutene; an α-olefin being a polymer of $C_8$-$C_{14}$ α-olefin; a dispersed or non-dispersed poly(meta) acrylate; a polymer having a main chain of poly(meta) acrylate and side chains of polymer of olefin; styrene-diene hydrogenated copolymer; styrene-maleic anhydride ester copolymer; polyalkylstyrene and the like can be exemplified.

In the present invention, "(meta) acrylate" refers to "acrylate or methacrylate".

As the component (B) in the present invention, a copolymer of an α-olefin and an α,β-ethylenic unsaturated dicarboxylic acid diester is especially preferable. By using such a copolymer as the component (B), it is possible to further improve its viscosity temperature characteristic while sustaining shear stability.

In the present invention, "α,β-ethylenic unsaturated dicarboxylic acid" refers to a chemical compound being an unsaturated dicarboxylic acid, wherein α carbon and β carbon of at least one of carboxy groups have an ethylenic unsaturated bond (that is, C=C double bond). That is, "α,β-ethylenic unsaturated dicarboxylic acid" is not limited to a chemical compound in which α carbon and β carbon of each of the carboxy groups has an ethylenic unsaturated bond and at the same time α,β-ethylenic unsaturated bond exists in its main chain, such as maleic acid, fumaric acid, citraconic acid, mesaconic acid, but includes a chemical compound in which α carbon and β carbon of only one of the carboxy groups have an ethylenic unsaturated bond such as glutaconic acid as well, and also includes a chemical compound in which α,β-ethylenic unsaturated bonds are found in its side chains such as itaconic acid.

The copolymer of an α-olefin and an α,β-ethylenic unsaturated dicarboxylic acid diester is a known chemical compound. As one example thereof, in the specification of U.S. Pat. No. 2,543,964, copolymers of $C_8$-$C_{18}$ α olefin and maleic acid diester or fumaric acid diester and the like of mixture of $C_{12}$ alcohol, $C_{14}$ alcohol or $C_{10}$-$C_{18}$ alcohol are disclosed. Also, in the similar copolymers disclosed in the specification of EP Patent No. 0075217, the alcohol that forms diester is a straight or branched alkylalcohol having a chain length of $C_3$-$C_{10}$, having weight average molecular weight of 1300 to 3250 and viscosity at 100° C. of up to 80 $mm^2/s$. Also, Japanese Patent Application Laid-Open No. 2008-308688 discloses a copolymer of $C_{12}$-$C_{18}$ α-olefin and an α,β-ethylenic unsaturated dicarboxylic acid diester, wherein an α,β-ethylenic unsaturated dicarboxylic acid diester made by esterizing an α,β-ethylenic unsaturated dicarboxylic acid by a $C_3$-$C_7$ linear or brunched alkyl alcohol is used as a comonomer, the copolymer of $C_{12}$-$C_{18}$ α-olefin and an α,β-ethylenic unsaturated dicarboxylic acid diester having weight average molecular weight of more than 3500, and having viscosity at 100° C. of more than 300 $mm_2/s$.

In the present invention, in a case where a copolymer of α-olefin and an α,β-ethylenic unsaturated dicarboxylic acid diester is used as the component (B), as long as its weight average molecular weight is no more than 15000, structure of the copolymer is not particularly limited. Its producing method is not particularly limited either, and the copolymer produced by a known method can be used.

The weight average molecular weight of the component (B) is no more than 15000, more preferably no more than 11000. Also, preferably no less than 1000, for example, can be no less than 2000, or no less than 4000. By having the weight average molecular weight of the component (B) of no more than the value upper limit value described above, it is possible to improve shear stability. Also, by having the weight average molecular weight of the component (B) of no less than the lower limit value described above, it is possible to increase viscosity index.

Here, the weight average molecular weight mentioned here means a weight average molecular weight in terms of a standard polystyrene measured by means of a differential refractive index (RI) detector under conditions of temperature 23° C., flow speed of 1 mL/min, sample concentration of 1 mass %, sample injection amount of 75 μL, using two columns GMHHR-M (7.8 mmID×30 cm) made by Tosoh Corporation in series in 150-C ALC/GPC system made by Waters Corporation, and using tetrahydrofuran as a solvent.

Kinematic viscosity at 100° C. of the component (B) is preferably no less than 30 $mm^2/s$, more preferably no less than 50 $mm^2/s$, still preferably no less than 100 $mm^2/s$, especially preferably no less than 200 $mm^2/s$, further especially preferably no less than 350 $mm^2/s$, and most preferably no less than 500 $mm^2/s$. Also, preferably no more than 1500 $mm^2/s$, more preferably no more than 1200 $mm^2/s$, still preferably no more than 1000 $mm^2/s$, especially preferably no more than 900 $mm^2/s$, and most preferably no more than 800 $mm^2/s$.

By having the kinematic viscosity at 100° C. of the component (B) of no less than the lower limit value described above, it is possible to sufficiently form oil membrane at lubricating points thereby increasing metal fatigue preventing property and load resistance capacity. Also, by having the kinematic viscosity at 100° C. of the component (B) of no more than the upper limit value described above, it is possible to further increase shear stability.

Viscosity index of the component (B) is not particularly limited, however, preferably no less than 120, more preferably no less than 140, still preferably no less than 155, especially preferably no less than 180, further especially preferably no less than 200, and most preferably no less than 250.

Also, in view of having an improved solubility with the component (A), preferably no more than 300, more preferably no more than 285, still preferably no more than 270, and especially preferably no more than 260. By having the viscosity of the component (B) of no less than 120, it is possible to obtain a lubricating oil composition having an improved viscosity temperature characteristic and an improved low-temperature viscosity characteristic.

Content of the component (B) in the lubrication oil composition of the present invention is, based on the total amount of the composition, preferably no less than 5 mass %, more preferably no less than 7 mass %, still preferably no less than 10 mass %, and preferably no more than 40 mass %, more preferably no more than 35 mass %, still preferably no more than 30 mass %.

By having the content of the component (B) within the range described above, it is possible to further improve the effect of the present invention.

<Component (C)>

The lubricating oil composition of the present invention can include, in addition to the components (A) and (B) described above, a synthetic base oil having kinematic viscosity at 100° C. of 1 to 10 $mm^2/s$ as a component (C).

As the synthetic base oil that can be used as the component (C) in the present invention, in specific, polybutene or hydride thereof; poly-α olefin of 1-octen oligomer, 1-decene oligomer and the like or hydride thereof; aromatic synthetic oil of alkylnaphthalene, alkylbenzene and the like; ester base oil; mixture of the above and the like can be exemplified. As the component (C), one kind of a synthetic base oil can be used alone, or two or more kinds of synthetic base oils can be used in combination.

Kinematic viscosity at 100° C. of the component (C) is preferably no less than 1.0 $mm^2/s$, more preferably no less than 1.5 $mm^2/s$, still preferably no less than 2.0 $mm^2/s$, especially preferably no less than 2.3 $mm^2/s$, and most preferably no less than 2.5 $mm^2/s$. Also, preferably no more than 10 $mm^2/s$, more preferably no more than 5 $mm^2/s$, still preferably no more than 4 $mm^2/s$, especially preferably no more than 3.5 $mm^2/s$ and most preferably no more than 3.0 $mm^2/s$.

By having the kinematic viscosity at 100° C. of the component (C) of no less than the lower limit value described above, it is possible to sufficiently form oil membrane at lubricating points to increase load resistance capacity, and it is also possible to further reduce evaporation loss of the base oil of the lubricating oil. Also, by having the kinematic viscosity at 100° C. of the component (C) of no more than the upper limit value described above, it is possible to further improve its viscosity temperature characteristic and low-temperature viscosity characteristic.

Viscosity index of the component (C) is not particularly limited, however, preferably no less than 100, more preferably no less than 120, still preferably no less than 140, especially preferably no less than 160, further especially preferably no less than 170, and most preferably no less than 180. By having the viscosity index of the component (C) of no less than the lower limit value described above, it is possible to obtain a lubricating oil composition having a better viscosity temperature characteristic and a better low-temperature viscosity characteristic. Also, as one embodiment of the present invention, the viscosity index of the component (C) can be more than 300, however, in view of having a better solubility (compatibility) with the component (A), preferably no more than 300, more preferably no more than 250, still preferably no more than 230, further preferably no more than 220, especially preferably no more than 210, further especially preferably no more than 200, and most preferably no more than 195.

As the synthetic base oil of the component (C), ester base oil is preferable. Alcohol that configures the ester base oil can be a monohydric alcohol or polyhydric alcohol, and acid that configures the ester synthetic base oil can be a monobasic acid or polybasic acid. Also, as long as the base oil has an ester bond, the base oil can include a complex ester compound. However, preferably monoester or diester, and more preferably monoester.

Combination of the alcohol and acid that form the ester base oil is unprescribed and not particularly limited. As the ester base oil that can be used in the present invention, for example, esters of (a) to (g) below can be exemplified. Each ester can be used alone, or two or more kinds of the esters can be used in combination.

(a) ester of a monohydric alcohol and a monobasic acid
(b) ester of a polyhydric alcohol and a monobasic acid
(c) ester of a monohydric alcohol and a polybasic acid
(d) ester of a polyhydric alcohol and a polybasic acid
(e) mixed ester of a mixture of monohydric alcohol and polyhydric alcohol and a polybasic acid
(f) mixed ester of a polyhydric alcohol and a mixture of mono basic acid and polybasic acid
(g) mixed ester of a mixture of monohydric alcohol and polyhydric alcohol and a mixture of monobasic acid and polybasic acid Among (a) to (g) described above, since they have a better lubricity, (a), (b), or (c) is preferable, and the ester of a monohydric alcohol and a mono basic acid (above (a)) or the ester of a monohydric alcohol and a dibasic acid (falls into above (c)) is more preferable. As the component (C) of the present invention, monoester of a monohydric alcohol and a mono basic acid (above (a)) is especially preferable.

Regarding the component (C), the ester to be obtained in a case where a polyhydric alcohol is used as its alcohol component (above (b) and (d) to (g)) can be a complete ester in which all hydroxyl groups in the polyhydric alcohol are esterified, or can be a partial ester in which some of the hydroxyl groups is(are) remained as a hydroxyl group(s) not being esterified. Also, an organic acid ester to be obtained in a case where a poly basic acid is used as its acid component (above (c) to (g)) can be a complete ester in which all carboxy groups in the poly basic acid are esterified, or can be a partial ester in which some of the carboxy groups is(are) remained as a carboxy group(s) not being esterified.

The ester base oil of the component (C) used in the present invention can be configured by only one kind from the ester compounds described above, or can be configured by a mixture of two or more kinds from the ester compounds.

Viscosity index of the ester base oil is not particularly limited, however, preferably no less than 170, more preferably no less than 180, still preferably no less than 190. Also, in view of improving mixing stability with the component (A) and storage stability, preferable no more than 300, more preferably no more than 250, still preferably no more than 230, and especially preferably no more than 210.

Content of the component (C) in a case where the component (C) is contained in the lubricating oil composition of the present invention, based on mixed-base oil of the components (A) and (C) (100 mass %), it is needed to be no more than 60 mass %, preferably no more than 55 mass %, more preferably no more than 50 mass %. Also, it is preferable to be no less than 5 mass %, more preferably no less than 10 mass %, still preferably no less than 20 mass %, and further preferably no less than 30 mass %.

By having the content of the component (C) of no more than 60 mass %, it is possible to improve oxidation stability, and by containing the component (C) a lot, it is possible to improve fuel-saving performance and lubricity. By having the content of the component (C) of no less than the lower limit value described above, it is possible to improve viscosity temperature characteristic, low-temperature viscosity characteristic and fatigue preventing capacity.

As long as the lubricating oil composition of the present invention includes the component (A), or the components (A) and (C) (hereinafter sometimes referred to as "the component (A) (and the component (C))" in short) as main component of its base oil, (E) a mineral base oil and/or a synthetic base oil used for a general lubricating oil, which does/do not fall into the component (A) or the component (C) (hereinafter sometimes referred to as "component (E)" or "base oil (E)" in short) can be used together with the component (A) (and the component (C)). In this case, content of the component (A) (and the component (C)) is, based on total amount of the base oil of lubricating oil, preferably no less than 50 mass %, more preferably no less than 70 mass %, still preferably no less than 85 mass %, and preferably no more than 99 mass %, more preferably no more than 97 mass %, still preferably no more than 95 mass %.

The base oil of lubricating oil in the lubricating oil composition of the present invention can be, in addition to a case where the base oil is a mineral base oil that falls into the component (A), a mixed base oil including the above components (A) and (C), or, a mixed base oil further including, in addition to the above components (A) (and the component (C)), the component (E) described above. Kinematic viscosities at 100° C. of these mixed base oils are not particularly limited, however, preferably no more than 3.5 $mm^2/s$, more preferably no more than 3.2 $mm^2/s$, still preferably no more than 3.0 $mm^2/s$, especially preferably no more than 2.9 $mm^2/s$, most preferably no more than 2.8 $mm^2/s$, and preferably no less than 1 $mm^2/s$, more preferably no less than 2 $mm^2/s$, still preferably no less than 2.3 $mm^2/s$, especially preferably no less than 2.5 $mm^2/s$.

In a case where a lubricating base oil in the lubricating oil composition of the present invention includes, in addition to the above component (A), the component (C) and/or the component (E), viscosity index of the mixed base oil is preferably no less than 100, more preferably no less than 105, still preferably no less than 110, especially preferably no less than 115, and most preferably no less than 120. Also, as one embodiment of the present invention, the viscosity index can be no less than 210, however, in view of having a much better oxidation stability, preferably no more than 200.

<Component (D)>

The lubricating oil composition of the present invention preferably further includes (D) an amide friction modifier.

In the present invention, as the component (D), an aliphatic acid amide compound can be preferably used. As preferable examples of the aliphatic acid amid compound, an aliphatic amide, an aliphatic imide, an aliphatic urea, an aliphatic hydrazide and the like can be raised. In specific, for example an aliphatic amide compound of general formulas (1) to (3) below can be raised. In the present invention, the "amide compound" includes an imide compound. Also, urea is diamide of carbonic acid, however, in the specification of the present invention, carbonic acid is treated as being included in an aliphatic acid.

[Chemical Formula 1]

(1)

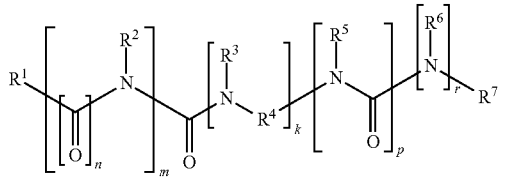

In general formula (1) above, $R^1$ is an alkyl group having 10 to 30 carbon atoms or an alkenyl group having 10 to 30 carbon atoms, preferably an alkyl group having 12 to 24 carbon atoms or an alkenyl group having 12 to 24 carbon atoms, preferably in a linear manner or having one methyl and remaining portion is in a linear manner. $R^2$, $R^3$, and $R^5$ each independently is a hydrogen atom or an alkyl group having 1 to 3 carbon atoms, especially preferably a hydrogen atom. $R^4$ is an alkylene group having 1 to 4 carbon atoms, preferably having 2 carbon atoms. $R^6$ and $R^7$ each independently is a hydrogen atom, an alkyl group having 1 to 30 carbon atoms, or hydroxyalkyl group having 1 to 3 carbon atoms, especially preferably is a hydrogen atom, k is an integer of 0 to 4, preferably an integer of 1 to 4, and m is an integer of 0 to 2. Also, n, p, and r each independently is 0 or 1. However, all of m, k, p, and r do not simultaneously represent 0. As a preferable combination of m and n in the general formula (1) above is, m=0 (amide), or m=1 and n=0 (urea) can be exemplified. In a case where m=0, or m=1 and n=0, combination of k, p and r are not particularly limited, however, as a typical example, k=p=0 and r=1 can be raised. Also, when p=1, an amido compound of the general formula (1) above has a structure in which both ends of its main chain each has an amide bond, and such a structure also can be preferably employed.

[Chemical Formula 2]

(2)

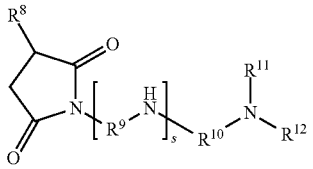

In general formula (2) above, $R^8$ is an alkyl group having 10 to 30 carbon atoms or an alkenyl group having 10 to 30 carbon atoms, preferably an alkyl group having 12 to 24 carbon atoms or an alkenyl group having 12 to 24 carbon atoms, preferably in a linear manner or having one methyl and remaining portion is in a linear manner. $R^9$ and $R^{10}$ each independently is an alkykene group having 1 to 4 carbon atoms, preferably having 2 carbon atoms. $R^{11}$ and $R^{12}$ each independently is a hydrogen atom, an alkyl group having 1 to 3 carbon atoms or a hydroxyalkyl group having 1 to 3 carbon atoms, especially preferably is a hydrogen atom. Also, s is an integer of 0 to 4, preferably an integer of 1 to 4.

[Chemical Formula 3]

(3)

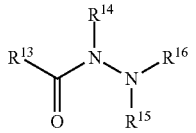

In general formula (3) above, $R^{13}$ is an aliphatic hydrocarbon group having 1 to 30 carbon atoms or a functionalized aliphatic hydrocarbon group having 1 to 30 carbon atoms, preferably an aliphatic hydrocarbon group having 10 to 30 carbon atoms or a functionalized aliphatic hydrocarbon group having 10 to 30 carbon atoms, more preferably an alkyl group having 12 to 24 carbon atoms, an alkenyl group having 12 to 24 carbon atoms, or a functionalized aliphatic hydrocarbon group having 12 to 24 carbon atoms, still preferably an alkyl group having 12 to 20 carbon atoms, an alkenyl group having 12 to 20 carbon atoms or a functionalized aliphatic hydrocarbon group having 12 to 20 carbon atoms, and especially preferably an alkenyl group having 12 to 20 carbon atoms. $R^{14}$, $R^{15}$, and $R^{16}$ each independently is a hydrocarbon group having 1 to 30 carbon atoms or a functionalized hydrocarbon group having 1 to 30 carbon atoms or a hydrogen atom, preferably a hydrocarbon group having 1 to 10 carbon atoms or a functionalized hydrocarbon group having 1 to 10 carbon atoms or a hydrogen atom, more preferably a hydrocarbon group having 1 to 4 carbon atoms or a hydrogen atom, and still preferably a hydrogen atom.

As the alkyl group above, in view of solubility, preferably an alkyl group having 1 to 3 of methyl. Number of the methyl is preferably 1. Also, position of the methyl is most preferably α position.

Herein, the "functionalized aliphatic hydrocarbon group" refers to an aliphatic organic group having a structure in which a hydrogen atom of the aliphatic hydrocarbon group to be a parent (preferably an alkyl group or an alkenyl group. Hereinafter referred to as "parent group" in short.) is substituted by a functional group including a hetero atom. The number of carbon atoms of the "functionalized hydrocarbon group" is a number of the carbon atoms as a whole group including its functional group. The number of carbon atoms of the parent group is within the range of the number of carbon atoms of the "functionalized aliphatic hydrocarbon group" described above. That is, for example, the number of carbon atoms of the parent group in the "functionalized aliphatic hydrocarbon group having 10 to 30 carbon atoms" is 10 to 30. The number of the "functioning group including a hetero atom" inserted in the parent group (hereinafter referred to as "substitution number" in short) is no less than 1, normally no more than the number of carbon atoms of the parent group, typically no more than the smallest integer in the range of no less than ½ of the number of carbon atoms of the parent group, more typically no more than the smallest integer in the range of no less than ¼ of the number of carbon atoms of the parent group, especially typically no more than 3, and most typically 1 or 2. As examples of the hetero atom, an oxygen atom, a nitrogen atom, a sulfur atom, a phosphorus atom and the like can be raised. The "functioning group including a hetero atom" may have one or more of aliphatic hydrocarbon groups (preferably alkyl group or alkenyl group). As preferable examples of the "functioning group including a hetero atom", a hydroxy group, a carboxy group, an aliphatic hydrocarbyloxy group, an aliphatic hydrocarbyloxycarbonyl group, an aliphatic hydrocarbyloyloxy group, N-aliphatic substitutional or non-substitutional aminocarbonyl group, N-aliphatic hydrocarbon group substitutional or non-substitutional aliphatic hydrocarbyroylamino group, N-aliphatic hydrocarbon group substitutional or non-substitutional amino group and the like can be raised.

Amide compound represented by the general formula (3) is, specifically, a hydrazide or a derivative thereof having a hydrocarbon group having 1 to 30 carbon atoms or a functionalized hydrocarbon group having 1 to 30 carbon atoms. In a case where $R^{13}$ is a hydrocarbon group having 1 to 30 carbon atoms or a functionalized hydrocarbon group having 1 to 30 carbon atoms and $R^{14}$, $R^{15}$ and $R^{16}$ each are a hydrogen atom, the amide compound of the general formula (3) is a hydrazide having a hydrocarbon group having 1 to 30 carbon atoms or a hydrazide having a functionalized hydrocarbon group having 1 to 30 carbon atoms. In a case where any of $R^{14}$ to $R^{16}$ and $R^{13}$ each are a hydrocarbon group having 1 to 30 carbon atoms or a functionalized hydrocarbon group having 1 to 30 carbon atoms, and remaining of $R^{14}$ to $R^{16}$ is/each are a hydrogen atom, the amide compound of the general formula (3) above is N or N'-substitutional hydrazide having a hydrocarbon group having 1 to 30 carbon atoms or a functionalized hydrocarbon group having 1 to 30 carbon atoms.

<Other Additive Agent>

(Viscosity Index Improver)

The lubricating oil composition of the present invention can contain a viscosity index improver. As the viscosity index improver, specifically, a so-called non-dispersive viscosity index improver being a (co) polymer of one or two or more of monomers of different methacrylate esters, a so-called dispersive viscosity index improver in which polar monomers including a nitrogen atom are further copolymerized and the like can be exemplified. As specific examples of other viscosity index improvers, a non-dispersive or dispersive ethylene-α-olefin copolymer (as the α-olefin, propylene, 1-butene, 1-pentene and the like can be exemplified.) or a hydride thereof, a polyisobutylenes or a hydride thereof, a styrene-diene hydrogenated copolymer, a stylene-maleic anhydride ester copolymer, a polyalkylstylene and the like can be raised. In the present invention, an arbitrary amount of one or two or more kinds of compounds arbitrarily selected from the above viscosity index improvers can be contained. However, in view of further increasing low-temperature viscosity characteristic and fatigue preventing performance, a non-dispersive or dispersive polymethacrylate is preferable, and a non-dispersive polymethacrylate is especially preferable.

Weight average molecular weight (Mw) of the viscosity index improver is, in view of having a better viscosity temperature characteristic and a better low-temperature performance and enabling to improve its fuel-saving performance, preferably more than 15000, more preferably no less than 20000. On the other hand, the upper limit value of the weight average molecular weight of the viscosity index improver is not particularly limited, however, in view of enabling to further improve its shear stability, preferably no more than 70000, more preferably no more than 50000, still preferably no more than 40000, and especially preferably no more than 30000. The weight average molecular weight can be obtained by GPC (Gel Permeation Chromatography) in terms of a standard polystyrene in a same manner as described above.

Content of the viscosity index improver in the lubricating oil composition of the present invention is, based on the total amount of the lubricating oil composition, preferably 0.01 to 20 mass %, more preferably 5 to 15 mass %. By having the content of the viscosity index improver within the above range, it is possible to improve viscosity index of the composition and at the same time it is possible to improve low-temperature viscosity characteristic and fatigue preventing performance.

Also, the lubricating oil composition of the present invention can contain various types of additive agents as needed, as long as the additive agents do not impair good viscosity temperature characteristic, low-temperature performance, fatigue preventing performance and load resistance. As such additive agents, without particular limitations, arbitrary additive agents that are conventionally used in a field of lubricating oil can be added. As such additive agents, in specific, metallic detergents, ashless dispersants, antioxidizing agents, extreme-pressure agents, antiwear agents, friction modifiers, pour point depressants, corrosion inhibitors, rust preventive agents, demulsifiers, metal inactivating agents, defoaming agents can be exemplified. One kind of the additive agents can be used alone, or two or more kinds of the additive agents can be used in combination.

(Metallic Detergent)

As the metallic detergents, sulfonate detergents, salicylate detergents, phenate detergents and the like can be exemplified, and any of a normal salt with an alkali metal or a group 2 element (alkaline-earth metal in a broad sense), a basic salt, and a perbasic salt can be added. On its use, one kind or two or more kinds arbitrary selected from above metallic detergents can be added.

In the lubricating oil composition of the present invention, a sulfonate detergent is preferable, and as a metal, a group 2 element (alkaline-earth metal in a broad sense) is preferable, and a magnesium element is especially preferable. As a preferable content, as a metal content based on the total amount of the composition, preferably no less than 0.05 mass %, more preferably no less than 0.1 mass %, and preferably no more than 0.5 mass %, more preferably no more than 0.3 mass %, and still preferably no more than 0.2 mass % A metallic detergent is effective for inhibiting acid value increase due to oxidation and improving wear resistance, especially in manual transmissions, effective for improving gear shifting, in automatic transmissions, effective for improving friction property of wet friction clutches, in continuously variable transmissions, effective for improving friction index between belt and pulley and the like.

(Ashless Dispersant)

As the ashless dispersants, an arbitrary ashless dispersant used for a lubricating oil can be applied, for example, a mono or bis succinic imide having, in its molecule, at least one linear or branched alkyl group having 40 to 400 carbon atoms or one linear or branched alkenyl group having 40 to 400 carbon atoms, a benzylamine having, in its molecule, at least one alkyl group having 40 to 400 carbon atoms or one alkenyl group having 40 to 400 carbon atoms, a polyamine having, in its molecule, at least one alkyl group having 40 to 400 carbon atoms or one alkenyl group having 40 to 400 carbon atoms, or a modified product thereof by a boron compound, carboxylic acid, phosphoric acid and the like can be exemplified. In its use, one kind or two or more kinds arbitrary selected from the above can be combined.

(Antioxidizing Agent)

As the antioxidizing agents, ashless antioxidizing agents of phenol series, amine series and the like, metallic antioxidizing agents of copper series, molybdenum series and the like can be exemplified.

(Extreme Pressure Agent/Antiwear Agent)

As the extreme pressure agents and antiwear agents, arbitrary extreme pressure agents and antiwear agents used for a lubricating oil can be applied. For example, an extreme pressure agent of sulfur series, phosphorus series, sulfur-phosphorus series and the like can be used. In specific, phosphorus esters, thiophosphorous esters, dithiophosphorous esters, trithiophosphorous esters, phosphoric acid esters, thiophosphoric acid esters, dithiophosphoric acid esters, trithiophosphoric acid esters, amine salts thereof, metal salts thereof, derivatives thereof, dithiocarbamates, zinc dithiocarbamates, molybdenum dithiocarbamates, disulfides, polysulfides, olefin sulfides, sulfilized greases and the like can be exemplified.

(Pour Point Dipressant)

As the pour point dipressants, for example, polymethacrylate polymers that adapt to a lubricating base oil to be used can be applied.

(Corrosion Inhibiter)

As the corrosion inhibiters, for example, benzotriazole-based, tolyltriazole-based, thiadiazole-based, and imidazole-based compounds and the like can be raised.

(Rust Preventive Agent)

As the rust preventive agents, for example, petroleum sulfonates, alkylbenzene sulfonates, dinonylnaphthalene sulfonates, alkenylsuccinic acid esters, polyhydric alcohol esters can be raised.

(Demulsifier)

As the demulsifiers, for example, polyalkylene glycol based non ionic surfactants and the like such as polyoxyethylene alkyl ethers, polyoxyethylene alkyl phenyl ethers, polyoxyethylene alkyl naphthyl ethers and the like can be raised.

(Metal Inactivating Agent)

As the metal inactivating agents, for example, imidazolines, pyrimidine derivatives, alkylthiadiazoles, mercaptobenzothiazoles, benzotriazoles or derivatives thereof, 1,3,4-thiadiazole polysulfides, 1,3,4-thiadiazolyl-2,5-bisdialkyldithiocarbamates, 2-(alkyldithio)benzoimidazoles, β-(o-carboxybenzylthio)propionic nitriles and the like can be raised.

(Defoaming Agant)

As the defoaming agents, for example, silicone oils having a kinematic viscosity at 25° C. of 0.1 $mm^2/s$ or more and less than 100 $mm^2/s$, alkenylsuccinic derivatives, esters of polyhydroxy aliphatic alcohols and long-chain aliphatic acids, methyl salicylates, o-hydroxy benzyl alcohols and the like can be raised.

In a case where these additive agents are contained to the lubricating oil composition of the present invention, each content thereof is, based on the total amount of the composition, preferably 0.1 to 20 mass %.

<Physical Property of Lubricating Oil Composition>

Kinematic viscosity at 100° C. of the lubricating oil composition of the present invention is not particularly limited, however, preferably no more than 10.0 $mm^2/s$, more preferably no more than 8 $mm^2/s$, still preferably no more than 7 $mm^2/s$, and especially preferably no more than 6.5 $mm^2/s$. Also, preferably no less than 2 $mm^2/s$, more preferably no less than 3 $mm^2/s$, still preferably no less than 4 $mm^2/s$, especially preferably no less than 5 $mm^2/s$, and most preferably no less than 5.5 $mm^2/s$. By having the kinematic viscosity at 100° C. of no less than the lower limit value described above, it becomes easy to improve retention capacity of oil membrane at lubricating portion and evaporation inhibiting capacity. Also, by having the kinematic viscosity at 100° C. of no more than the upper limit value described above, it becomes easier to improve fuel-saving performance.

Viscosity index of the lubricating oil composition of the present invention is not particularly limited, however, preferably no less than 150, more preferably no less than 160, still preferably no less than 170, and especially preferably no less than 175. By having the viscosity index of no less than the lower limit value described above, it becomes easy to improve fuel-saving performance.

Traction coefficient of the lubricating oil composition of the present invention is not particularly limited, however, preferably no more than 0.012, more preferably no more than 0.010, more preferably no more than 0.009. By having the traction coefficient of no more than the upper limit value described above, it is possible to further improve fuel-saving performance to be exerted.

In the present invention, the traction coefficient is a value measured by means of an EHL tester (EHD2, manufactured by PCS Instruments), under conditions of a temperature of 40° C., an average speed of 3.0 m/s, a slip ratio of 10%, a load of 0.4 GPa.

EXAMPLES

Hereinafter, the present invention will be further specifically explained based on Examples and Comparative Examples. However, the present invention is not limited to these Examples.

Examples 1 to 5, and Comparative Examples 1 to 3

As shown in Table 1, lubricating oil compositions of the present invention (Examples 1 to 5), and lubricating oil compositions for comparison (Comparative Examples 1 to 3) were prepared.

TABLE 1

| | | | Example 1 | Example 2 | Example 3 | Example 4 | Example 5 | Comparative Example 1 | Comparative Example 2 | Comparative Example 3 |
|---|---|---|---|---|---|---|---|---|---|---|
| (A)Base Oil | Based on Total Amount of Base Oil | | | | | | | | | |
| O-1 | Base Oil 1 | inmass % | 100 | | 100 | 100 | 50 | | 100 | |
| O-2 | Base Oil 2 | inmass % | | 100 | | | | | | |
| O-3 | Base Oil 3 | inmass % | | | | | | 100 | | 100 |
| O-4 | Base Oil 4 | inmass % | | | | | 50 | | | |
| (B)Polymer | | | | | | | | | | |
| B-1 | Polymer 1 | mass % | 13 | 23 | | | | 10 | | |
| B-2 | Polymer 2 | mass % | | | 15 | | | | | |
| B-3 | Polymer 3 | mass % | | | | 6 | 9 | | | |
| B-4 | Polymer 4 | mass % | | | | | | | 3 | 2 |
| Other Additive Agent | | | | | | | | | | |
| F-1 | Additive Agent Package | mass % | 10 | 10 | 10 | 10 | 10 | 10 | 10 | 10 |
| Evaluation Result | | | | | | | | | | |
| Kinematic Viscosity (40° C.) | | $mm^2/s$ | 27.7 | 25.8 | 28.1 | 27.4 | 24.5 | 29.9 | 24.6 | 27.5 |
| Kinematic Viscosity(100° C.) | | $mm^2/s$ | 6.0 | 6.0 | 6.0 | 6.0 | 6.0 | 6.0 | 6.0 | 6.0 |
| Viscosity Index | | | 171 | 185 | 168 | 174 | 208 | 150 | 207 | 176 |
| Traction Coefficient | | | 0.008 | 0.008 | 0.008 | 0.008 | 0.006 | 0.015 | 0.008 | 0.016 |
| Shear Stability Test(KRL 20 h) | | | | | | | | | | |
| Kinematic Viscosity after sharing (100° C.) Decreasing Ratio of Viscosity | | % | <1 | <1 | <1 | <1 | <1 | <1 | 13.3 | 12.0 |

Base Oil 1 % $C_P$: 95.0, % $C_N$: 4.4, 100° C. Kinematic Viscosity: 3.9, Viscosity Index: 142, Traction Coefficient: 0.007
Base Oil 2 % $C_P$: 93.7. % $C_N$: 6.2, 100° C. Kinematic Viscosity: 2.6, Viscosity Index: 127, Traction Coeffient: 0.007
Base Oil 3 % $C_P$: 79.4, % $C_N$: 20.6, 100° C. Kinematic Viscosity: 4.2, Viscosity Index: 127, Traction Coeffient: 0.014
Base Oil 4 Oleic acid2-ethylhexyl, 100° C. Kinematic Viscosity: 2.7, Viscosity Index: 182, Traction Coeffient: 0.004
Polymer 1 Mw 10000, copolymer of α-olefin and α,β-ethylenically unsaturated dicarboxylic acid diester
Polymer 2 Mw 6500, copolymer of α-olefin and α,β-ethylenically unsaturated dicarboxylic acid diester
Polymer 3 Mw 14800, copolymer of α-olefin and α,β-ethylenically unsaturated dicarboxylic acid diester
Polymer 4 Mw: 50,000, non-dispersive polymethacrylate
Additive Agent Package
ZDDP (Amount of Zn 0.15 mass %), Mg sulfonate(Amount of Mg 0.17 mass %), phosphoric acid ester/phosphorous ester, sulfur-based extreme pressire agent, non boron ashless dispersant agent, pour point dipressant, defoaming agent and the like
Traction Coefficient: Evaluated by means of EHL tester (Conditions: 40° C., Average speed of 3.0 m/s, Slip ratio of 10%, 0.4 GPa)
Shear Stability Test(KRL 20 h): in conformity with CEC L-45-T-99(Conditions: 40° C., Rotation speed of 1475 rpm, Load of 5000N)

Shear stability of the lubricating oil composition of the present invention is evaluated by decreasing ratio of the kinematic viscosity at 100° C. after 20-hour shearing by KRL testing method, and its evaluation value is preferably no more than 5%, more preferably no more than 3%, still preferably no more than 2%, and especially preferably less than 1%. By the decreasing ratio of the kinematic viscosity above being no more than 5%, it becomes easy to sufficiently secure oil pressure of inside of an apparatus in which the lubricating oil composition of the present invention is to be used.

The KRL testing is carried out under conditions of a temperature of 40° C., a rotation speed of 1475 rpm, a load of 5000N in conformity with CEC L-45-T-99.

In the table, regarding each base oil, "inmass %" refers to a content based on the total amount of the base oil (100 mass %). Regarding other components, "mass %" refers to a content based on the total amount of the lubricating oil composition (100 mass %).

In the Table 1, the base oils 1 and 2 fall into the component (A), the base oil 3 falls into the component (E), and the base oil 4 falls into the component (C). The polymers 1 to 3 are polymers that fall into the component (B), however, the polymer 4 is a polymer that does not fall into the component (B) since its weight average molecular weight is more than 15000.

(Evaluation Method 1: Traction Coefficient Measurement)

Regarding each of the lubricating oil compositions prepared as above, traction coefficient was measured. The traction coefficient measurement was carried out by means of an EHL tester (EHD2, manufactured by PCS Instruments), under conditions of a temperature of 40° C., an average speed of 3.0 m/s, a slip ratio of 10%, and a load of 0.4 GPa. Results are shown in Table 1. It means that a lubricating oil composition having the lower traction coefficient has the higher fuel-saving performance.

(Evaluation Method 2: Shear Stability Test)

Regarding each of the lubricating oil compositions prepared as above, shear stability was evaluated by decreasing rate of its kinematic viscosity at 100° C. after 20-hour sharing by KRL testing method. The KRL testing was carried out, in conformity with CEC L-45-T-99, by means of an apparatus manufactured by HANSA PRESS- and MASCHINENBAU GmbH, under conditions of a temperature of 40° C., a rotation speed of 1475 rpm, and a load of 5000N. Results are shown in Table 1. It means that a lubricating oil composition having the lower decreasing ratio of kinematic viscosity has the higher shear stability, therefore has the higher ability of sustaining lubricity.

(Evaluation Method 3: Viscosity Temperature Characteristic)

Regarding each of the lubricating oil compositions prepared as above, in conformity with JIS K2283, kinematic viscosities at 40° C. and 100° C. were measured whereby viscosity index was calculated.

(Evaluation Result)

Lubricating oil compositions of Examples 1 to 5 each showed a traction coefficient no more than 0.009, and at the same time their viscosities were not decreased after the KRL test. Also, each of the lubricating oil composition of Examples 1 to 5 had a viscosity index of no less than 160, therefore each had a good viscosity temperature characteristic.

Against this, the lubricating oil composition of Comparative Example 1 that contains only the component (E) as its base oil but does not contain the component (A) showed a large traction coefficient of 0.015.

The lubricating oil composition of Comparative Example 2 that contains a polymer having a large molecular weight (Mw=50000) instead of containing the component (B) was inferior in shear stability.

The lubricating oil composition of Comparative Example 3 that contains only the component (E) as its base oil but does not contain the component (A) and at the same time contains a polymer having a large molecular weight (Mw=50000) instead of containing the component (B) was inferior in both of traction coefficient and shear stability.

From the above results, it was shown that, according to the present invention, it is possible to provide a lubricating oil composition having an improved fuel-saving performance by reducing its traction coefficient, and at the same time having a improved shear stability.

Examples 6 to 12

As shown in Table 2, lubricating oil compositions of the present invention (Examples 6 to 12) are prepared.

TABLE 2

| | | | Example 6 | Example 7 | Example 8 | Example 9 | Example 10 | Example 11 | Example 12 |
|---|---|---|---|---|---|---|---|---|---|
| (A)Base Oil | Based on Total Amount of Base Oil | | | | | | | | |
| O-2 | Base Oil 2 | inmass % | 100 | 100 | 100 | 100 | 100 | 100 | 100 |
| (B)Polymer | | | | | | | | | |
| B-5 | Polymer 5 | mass % | 23 | 23 | 23 | 23 | 23 | 23 | 23 |
| (D)Performance Additive Agent | | | | | | | | | |
| D-1 | Friction Modifier 1 | mass % | 1.1 | | | | | | |
| D-2 | Friction Modifier 2 | mass % | | 1.05 | | | | | |
| D-3 | Friction Modifier 3 | mass % | | | 1.05 | | | | |
| D-4 | Friction Modifier 4 | mass % | | | | | 0.95 | | |
| D-5 | Friction Modifier 5 | mass % | | | | | | 1.21 | |
| D-6 | Friction Modifier 6 | mass % | | | | | | | 1.21 |
| F-1 | Additive Agent Package | mass % | 10 | 10 | 10 | 10 | 10 | 10 | 10 |
| Evaluation Result | | | | | | | | | |
| LFW-1, 40° C. and left, surface pressure of 0.3 GPa | | | | | | | | | |
| Speed | | 1.000 m/s | 0.070 | 0.071 | 0.073 | 0.083 | 0.082 | 0.082 | 0.085 |
| | | 0.500 m/s | 0.073 | 0.074 | 0.076 | 0.085 | 0.084 | 0.086 | 0.086 |
| | | 0.125 m/s | 0.076 | 0.079 | 0.079 | 0.089 | 0.089 | 0.090 | 0.092 |
| | | 0.075 m/s | 0.077 | 0.079 | 0.079 | 0.090 | 0.090 | 0.091 | 0.092 |
| | | 0.026 m/s | 0.074 | 0.077 | 0.079 | 0.092 | 0.093 | 0.090 | 0.094 |

Base Oil 2 % $C_P$: 93.7, % $C_N$: 6.2, 100° C. Kinematic Viscosity: 2.6, Viscosity Index: 127, Traction Coefficient: 0.007

Polymer 5 Mw: 10000, copolymer of α-olefin and α,β-ethylenically unsaturated dicarboxylic acid diester Friction Modifier 1 oleylurea (in general formula (1), $R^1$ = an oleyl group, $R^2$ = a hydrogen atom, m = 1, n = 0, k = p = 0, r = 1, $R^6$ = $R^7$ = a hydrogen atom)

Friction Modifier 2 oleylhydrazide (in general formula (3), $R^{13}$ = an oleyl group, $R^{14}$ = $R^{15}$ = $R^{16}$ = a hydrogen atom)

Friction Modifier 3 oleylamide (in general formula (1), $R^1$ = an oleyl group, m = 0, k = p = 0, r = 1, $R^6$ = $R^7$ = a hydrogen atom)

Friction Modifier 4 oleylamine

Friction Modifier 5 oleyl lactate

Friction Modifier 6 propanediololeylamine

Additive Agent Package

ZDDP (Amount of Zn 0.15 mass %), Mg sulfonate (Amount of Mg 0.17 mass %), phosphoric acid ester/phosphorous ester, sulfur-based extreme pressire agent, non boron ashless dispersant agent, pour point dipressant, defoaming agent and the like In Table 2, the friction modifiers 1 to 3 each are an amide-based friction modifier that falls into the component (D), and the friction modifiers 4 to 6 each are a friction modifier that does not fall into the component (D).

(Evaluation Method: Block-on-Ring Friction Test)

Regarding each of the lubricating oil compositions prepared as above, a block-on-ring friction test was carried out. The test was carried out by means of LFW-1 manufactured by FALEX Corporation. Measurement conditions were a temperature of 40° C., a surface pressure of 0.3 GPa, decreasing sliding speeds to 1.000 m/s, 0.500 m/s, 0.125 m/s, 0.075 m/s, 0.026 m/s in the order mentioned. Results are shown in Table 2.

(Evaluation Result)

FIG. 1 is a graph in which friction indexes of each lubricating oil compositions to the sliding speeds are plotted based on the evaluation results shown in Table 2.

The lubricating oil compositions of Examples 6 to 8 each containing the amide-based friction modifiers 1 to 3 that fall into the component (D) showed friction coefficients of less than 0.08 at all of the sliding speeds.

Against this, Examples 10 to 12 each containing the friction modifiers 4 to 6 that do not fall into the component (D) did not have significant differences from the Example 9 that did not contain friction modifiers at all.

From the results above, it was shown that, according to the lubricating oil composition of the present invention having a configuration in which the component (D) is contained, it is possible to further reduce its friction coefficient thereby enabling further improvement in its fuel-saving performance.

INDUSTRIAL APPLICABILITY

The lubricating oil composition of the present invention has an improved fuel-saving performance, and since it has an improved shear stability, the ability to maintain viscosity temperature characteristic has been improved. Therefore, it is especially suitable for manual and automatic transmissions and/or continuously variable transmissions of vehicles, constructing machines, agricultural machines and the like. Also, it can be suitably used as a lubricating oil for manual transmission and differential gears of vehicles, construction machines, agricultural machines and the like. Other than those, it can be favorably used as an industrial gear oil, a lubricating oil, a turbine oil and a compressor oil for gasoline engine, diesel engine, gas engine of vehicles such as two-wheel vehicles and four-wheel vehicles, power generation, marine vessels.

The invention claimed is:

1. A lubricating oil composition comprising:

(A) a mineral base oil having kinematic viscosity at 100° C. of no more than 5 mm2/s, and % CP of no less than 90; and (B) a polymer having weight average molecular weight of no more than 15000, wherein the component (B) is a copolymer of an α-olefin and an α,β-ethylenic unsaturated dicarboxylic acid diester.

2. The lubricating oil composition according to claim 1, wherein the (A) mineral base oil has % CN of no more than 15.

3. The lubricating oil composition according to claim 1, further comprising:

(D) an amide friction modifier.

4. The lubricating oil composition according to claim 1, which is a lubricating oil for transmission.

* * * * *